US005256992A

United States Patent [19]

Fasola et al.

[11] Patent Number: 5,256,992

[45] Date of Patent: Oct. 26, 1993

[54] ELECTRICAL SWITCH, PARTICULARLY FOR CONTROLLING THE SUPPLY OF CURRENT TO THE ELECTRIC STARTER MOTOR OF AN INTERNAL COMBUSTION ENGINE

[75] Inventors: Giancarlo Fasola, Milan; Giovanni Cerizza, Lodi; William T. Hyder, Milan, all of Italy

[73] Assignee: Industrie Magneti Marelli SpA, Milan, Italy

[21] Appl. No.: 784,542

[22] Filed: Oct. 29, 1991

[30] Foreign Application Priority Data

Dec. 4, 1990 [IT] Italy ..... 67965 A/90

[51] Int. Cl.[5] ..... H01H 67/02

[52] U.S. Cl. ..... 335/126; 335/131

[58] Field of Search ..... 335/126, 131

[56] References Cited

U.S. PATENT DOCUMENTS 3,409,851 11/1968 Scheib et al. .
3,472,984 10/1969 Cusick .
4,801,909 1/1989 Fasola ..... 335/126

FOREIGN PATENT DOCUMENTS 525601 1/1954 Belgium .
1003318 2/1957 Fed. Rep. of Germany .
1091194 10/1960 Fed. Rep. of Germany .
1104024 4/1961 Fed. Rep. of Germany .
0324262 7/1989 World Int. Prop. O. .

OTHER PUBLICATIONS

European Search Report; Application No. EP 91 83 0518; Search dated Mar. 9, 1992; Ex. J. Overdijk.

*Primary Examiner*—Lincoln Donovan
*Attorney, Agent, or Firm*—Fish & Richardson

[57] ABSTRACT

An electrical switch, particularly for controlling the supply of current to the electric starter motor of an internal combustion engine, in which the movable device and/or its control device are formed in such a way that, in its operating position, the movable contact oscillates after it has struck the fixed contacts and assumes successive configurations in which its deformation or deflection always keeps the same sign.

3 Claims, 3 Drawing Sheets

Figure 1:
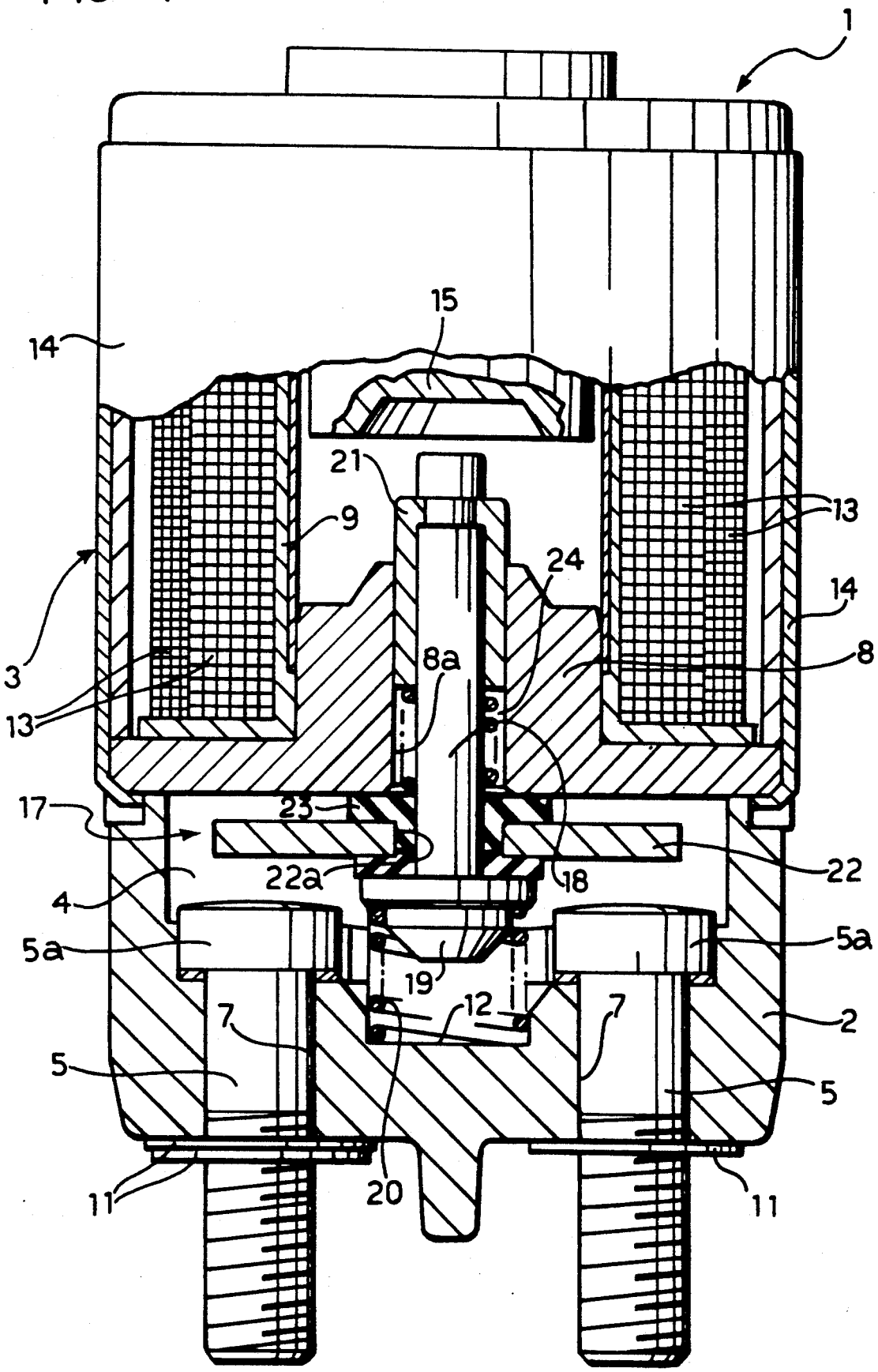

ELECTRICAL SWITCH, PARTICULARLY FOR CONTROLLING THE SUPPLY OF CURRENT TO THE ELECTRIC STARTER MOTOR OF AN INTERNAL COMBUSTION ENGINE

DESCRIPTION

The present invention relates to an electrical switch usable in particular for controlling the supply of current to the electric starter motor of an internal combustion engine.

More specifically, the invention concerns an electrical switch of the type including:

a support structure carrying two fixed contacts, a device which carries a movable contact and is movable relative to the support structure between a rest position in which the movable contact is separated from the fixed contacts and an operating position in which the movable contact is brought to bear against the fixed contacts, is deformed resiliently like a beam, and is subject to damped oscillations, and control means for moving the movable device between its rest position and its operating position.

In known devices, the control means typically comprise an electromagnet including an excitation coil or solenoid and an associated movable core which, when the solenoid is energised, can urge the movable device into the operating position defined above.

In devices produced up to now, the movable contact is usually constituted by a metal (copper) plate and the fixed contacts are usually arranged symmetrically of the axis of the movable device.

In these devices, when the control solenoid is energised, the movable contact is urged against the fixed contacts and may then "bounce" several times before it stops firmly against them.

This bouncing results in the striking of arcs and the material of the fixed contacts and the movable contact may fuse locally, with the danger that one or both ends of the movable contact may be welded ("stuck") to the fixed contacts. When this happens, the means for returning the movable device to its rest position (usually a spring) cannot detach the movable contact from the fixed contacts and, in this event, the electric starter motor of the internal combustion engine remains activated even after the control solenoid has been de-energised.

The object of the present invention is to provide a device of the type specified above, which does not have the disadvantages described above.

According to the invention, this object is achieved by means of an electrical switch of the aforesaid type, the main characteristic of which lies in the fact that the movable device and/or the control means are formed in such a way that, in the operating position, the movable contact oscillates after it has struck the fixed contacts and assumes successive configurations in which its curvature always has the same sign.

As will become clearer from the following, in the device according to the invention, it is impossible for the movable contact to move away from the fixed contacts during its damped oscillation after it has struck them so that the striking of arcs and the related damaging consequences are effectively prevented.

Figure 4:
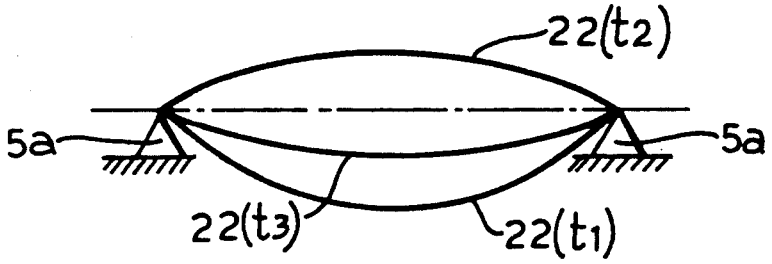
Figure 5:
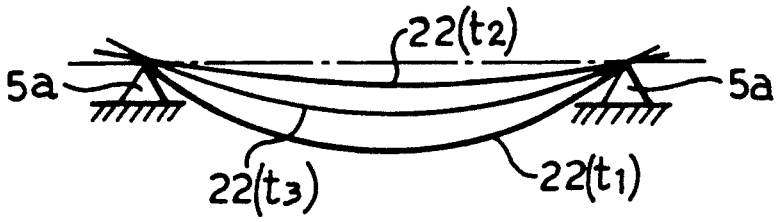
Figure 6:
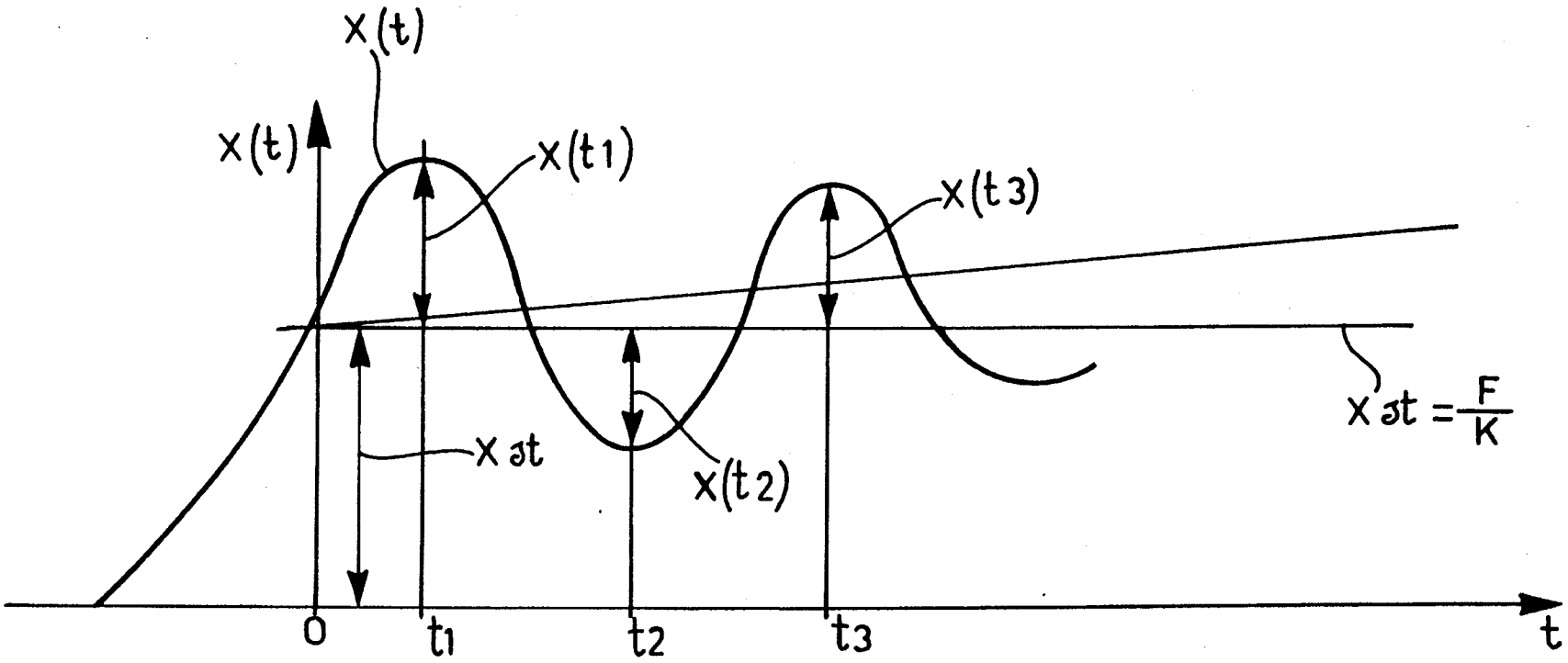

Further characteristics and advantages of the invention will now be made clear by the detailed description which follows, with reference to the appended drawings, provided purely by way of non-limiting example, in which:

FIG. 1 is a partially-sectioned view of an electrical switch according to the invention, FIGS. 2 to 5 are schematic diagrams relating to theoretical considerations upon which the present invention is based, and FIG. 6 is a graph showing the deflection of the movable contact of the switch according to the invention plotted against the time t shown on the absicssa.

In FIG. 1, an electrical switch usable, in particular, for controlling the supply of current to the electric starter motor (not shown) of an internal combustion engine, is generally indicated 1. It includes, in known manner, a substantially cup-shaped support 2 to the top of which an electromagnet, generally indicated 3, is fixed. The support 2 has a recess 4 in its side which faces the electromagnet 3. Screws of electrically-conductive material, preferably copper, indicated 5, extend through holes 7 in the base wall of the support 2.

In the embodiment illustrated, the screws 5 have respective hexagonal heads 5*a* which act as fixed contacts, as will become clear from the following.

The screws 5 are fixed to the support 2 by washers 11 force-fitted onto their respective threaded shanks.

The base wall of the recess 4 in the support 2 has a substantially cylindrical recess 12.

In known manner, the electromagnet 3 includes a tubular housing 14 in which a coil or solenoid 10 carried by a spool 9 is mounted.

A stop and guide element 8 with an axial hole 8*a* is inserted in the spool 9 at its end facing the support element 2.

The movable core of the electromagnet 3 is indicated 15. The core is movable in the axial hole in the spool 9.

A movable device, generally indicated 17, is movable axially in the axial hole 8*a* in the stop and guide element 8. The device comprises a rod 18 with a head 19 at its end facing the support element 2.

A helical spring, indicated 20, is disposed in the recess 12 in the support element 2 between the base wall of the recess and the head 19 of the rod 18.

A sleeve 21 is fixed to the other end of the rod 18 and is guided slidably in the hole 8*a* in the element 8.

A movable contact 22 in the form of a substantially rectangular conductor plate is fitted on the rod 18, between the guide sleeve 21 and the head 19 of the rod. The plate has a central hole 22*a* through which the rod 18 extends with the interposition of a washer 23.

A fairly stiff helical spring 24 is disposed around the rod 18 between the guide sleeve 21 and the washer 23. The spring is preloaded under compression and urges the movable contact 22 towards the position shown, that is, against the head 19 of the rod 18, with a force F.

The arms of the movable contact 22 face the fixed contacts constituted by the heads 5*a* of the screws 5.

As in prior-art devices, the energisation of the control solenoid 13 in operation causes the core 15 to be moved towards the movable device 17. The core 15 thus reaches the rod 18 of the device and urges it towards the fixed contacts 5*a*. Immediately after the movable contact 22 strikes the fixed contacts, the rod 18 still continues towards the base wall of the support element 2, further loading the helical spring 24.

In the device according to the invention, the bouncing or jumping of the movable contact on the fixed contacts after its initial impact is conveniently prevented by virtue of measures which will be described below after the explanation of some theoretical considerations or premises upon which the invention is based and which will now be explained with reference to FIGS. 2 to 6.

Figure 2:
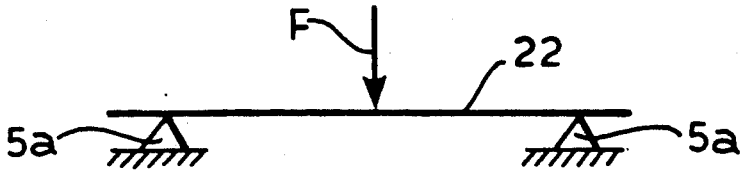

The movable contact 22 bearing on the fixed contacts 5a may be considered essentially as a resiliently deformable beam according to the simplified diagram of FIG. 2. The fixed contacts 5a represent the supports of the beam.

In the following description with reference to FIGS. 2 to 5, each time the term "beam" is used it actually means the movable contact and each time the term "supports" is used it means the fixed contacts.

In FIG. 2, the resultant of the forces acting on the movable contact 22 which bears on the fixed contacts 5a, due to the preloading of the spring 24 is indicated F. The force F is represented as a concentrated load but is actually the resultant of distributed forces.

Figure 3:
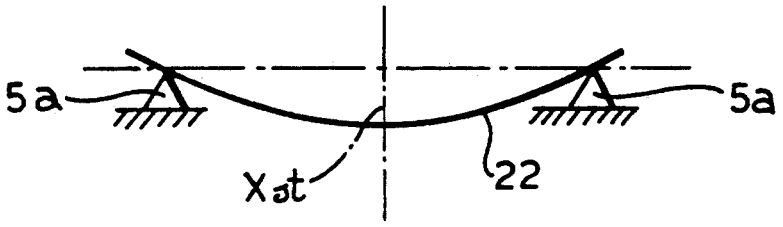

The beam 22 bends under the force F in the manner shown qualitatively in FIG. 3. In this drawing, the static deflection of the beam 22 from its undeformed condition (measured at the centre of the beam 22) when beam 22 is subject to the static load represented by the force F and to the reactions of the fixed contacts 5a is indicated $x_{st}$.

The ratio k between the force F and the static deflection $x_{st}$ is a characteristic of the beam 22 and will be defined below as the "elastic constant" of the beam.

As stated above, after it has struck the fixed contacts 5a, the movable contact 22 is resiliently deformed and is subject to damped dynamic vibrations.

Since the elastic constant of the helical spring 24 is typically much lower than that of the movable contact 22, the mode of the vibration of the system may be considered to be due only to the movable contact itself.

If $f_1$ indicates the basic frequency of the flexural vibration of the movable contact 22 the dynamic deflection or displacement at the centre of the movable contact 22 during vibration can be expressed as follows:

$$x(t) = \frac{V_o}{w} e^{-\mu t}\sin(wt) \tag{1}$$

in which $V_o$ is the speed of the movable contact 22 when its resilient reaction equals the preloading F of the spring 24, w is the angular frequency corresponding to the frequency $f_1$ ($w=2pi.f_1$), $\mu$ is a damping coefficient, and t is the time.

The speed of the displacement of the centre of the movable contact is derived from the equation (1) above and can thus be expressed as follows:

$$\dot{x}(t) = \frac{V_o}{w}\left[-\mu e^{-\mu t}\sin(wt) + we^{-\mu t}\cos(wt)\right] \tag{2}$$

During the vibration, the speed of the centre of the movable contact becomes zero at successive moments which can be calculated as follows:

$$\dot{x}(t) = 0 \tag{3}$$

$$\mu e^{-\mu t}\sin(wt) = we^{-\mu t}\cos(wt)$$

-continued $$t = \frac{V_o}{w}\left[\tan^{-1}\left(\frac{w}{\mu}\right) + npi\right] \quad n = 0,1,2,\ldots$$

The speed of the centre of the movable contact will therefore first become zero at a moment $$t = t_1 = \frac{1}{w}\left[\tan^{-1}\left(\frac{w}{\mu}\right)\right] (n = 0) \tag{4}$$

With reference to FIG. 4, at the time $t_1$, the beam 22 will assume, for example, the configuration indicated 22 ($t_1$). This configuration corresponds to the maximum dynamic deflection of the beam.

The speed of the movable contact/beam 22 subsequently becomes zero at a moment $$t = t_2 = \frac{1}{w}\left[\tan^{-1}\left(\frac{w}{\mu}\right) + pi\right] (n = 1) \tag{5}$$

The configuration generally assumed by the beam 22 at the moment $t_2$ is indicated (qualitatively) 22($t_2$) in FIG. 4.

The speed of the movable contact/beam 22 then becomes zero again at the moment $$t = t_3 = \frac{1}{w}\left[\tan^{-1}\left(\frac{w}{\mu}\right) + 2pi\right] (n = 2) \tag{6}$$

and the configuration assumed by the movable contact/beam is correspondingly indicated 22 ($t_3$) in FIG. 4.

The movable contact/beam 22 has a smaller dynamic deflection at the moment $t_3$ than at the moment $t_1$. At the moments $t_1$ and $t_3$, therefore, the curvatures of the movable contact/beam 22 are different but have the same sign.

In general, the sign of the curvature of the movable contact/beam 22 at the moment $t_2$ (and at subsequent moments $t_{2n}$), resulting solely from its dynamic oscillation (and hence taking no account of the static load represented by the force F) is the opposite of that of its curvature at the moments $t_1$ and $t_3$ (and at subsequent moments $t_{2n+1}$).

If an electric switch of the type described above with reference to FIG. 1 is formed in such a way that its static deflection $x_{st}$ as defined above is greater than or at least equal to its dynamic deflection $x(t_2)$ at the moment $t_2$, then the overall deflection $X(t)=x_{st}+x(t)$ will always have the same sign. In other words, if this condition occurs in a real situation, after it strikes the fixed contacts 5a, the movable contact 22 is subject to damped vibrations as a result of which it assumes successive configurations in which its curvature always has the same sign, as shown in FIG. 5.

The fact that the movable contact 22 vibrates but remains deflected to the same side, that is, towards the fixed contacts, means that it is not raised from the contacts as could occur if it were able alternately to assume opposite curvatures during its vibration.

In view of the foregoing, the condition necessary for the movable contact/beam 22 always to bend to the same side can be expressed analytically as follows:

$$\frac{F}{K} \geqq \left| \frac{V_o}{w} e^{-\mu t_2} \sin(wt_2) \right| \quad (7)$$

In a simplified (but nevertheless conservative) hypothesis in which the damping factor $\mu$ is zero, the foregoing condition is further simplified as follows:

$$\frac{F}{K} \geqq \frac{V_o}{w} \quad (8)$$

and this can be rewritten as follows:

$$K \leqq \frac{wF}{V_o} \quad (9)$$

The equation (9) immediately provides a design criterion usable to ensure that the movable contact 22 does not bounce.

Thus, in designing a device of the type of FIG. 1, one can, for example, take the movements of a similar existing device and simply alter solely the dimensions of the movable contact member 22. The dimensions of this member should be such that it conforms to the equation (9) given above.

FIG. 6 of the appended drawings shows, by way of example, a curve of the overall deflection X(t) of the movable contact/beam of a device for which the equation (7) or (more conservatively) the equation (9) given above is satisfied.

In the graph of FIG. 6, the static deflection $x_{st}$ has been considered to be constant and equal to the ratio between the force F and the elastic constant k of the movable contact/beam 22.

Strictly, in a device of the type shown in FIG. 1, the action of the spring 24, which is further (though slightly) loaded after the movable contact 22 has struck the fixed contacts 5*a*, also contributes to the definition of the static deflection $x_{st}$. It should be noted, however, that the contribution to the static deflection due to this further loading of the spring 24 is extremely small if one takes account of the fact that it involves an extremely slow increase in the static deflection (as indicated, for example, by the broken line in FIG. 6), whilst the oscillations of the dynamic component take place at a very high frequency.

In general, in order to comply with the conditions expressed by the equation (7) or the equation (9), the designer can alter the mass of the movable contact 22 (on which its basic vibration frequency $f_1$ and hence its angular frequency $w=2pif_1$ depends), the flexural elastic constant k of the movable contact, the elastic constant of the spring 24, the preloading of the spring and the speed of the movable contact when it strikes the fixed contacts. This last parameter in turn depends on a series of factors such as the size of the control solenoid, the mass of the core 15, etc.

The principle of the invention remaining the same, therefore, the forms of embodiment and details of construction may be varied widely with respect to those described and illustrated purely by way of non-limiting example, without thereby departing from the scope of the present invention.

We claim:

1. An electrical switch, particularly for controlling the supply of current to the electric starter motor of an internal combustion engine, comprising:

a support structure and two fixed contacts carried upon said support structure, a movable device and a movable contact carried upon said movable device, said movable device being movable relative to said support structure between a rest position in which the movable contact, carried upon the movable device, is separated from the fixed contacts and an operating position in which the movable contact is brought to bear against the fixed contacts, said movable contact having the form of a resiliently deformable beam subject to damped oscillations, and control means for moving the movable device between its rest position and its operating position;

whereby, in the operating position of the moveable device, the movable contact oscillates after it has struck the fixed contacts, the magnitude of the oscillation bounded by an undeformed configuration of said movable contact, so as to maintain engagement of the movable contact with the two fixed contacts.

2. An electrical switch, particularly for controlling the supply of current to the electric starter motor of an internal combustion engine, comprising:

a support structure and two fixed contacts fixedly carried upon said support structure, a movable device and a movable contact carried upon said movable device, said movable device being movable relative to said support structure between a rest position in which the movable contact, carried upon the movable device, is separated from the fixed contacts and an operating position in which the movable contact is brought to bear against the fixed contacts, said moveable contact having the form of a resiliently deformable beam subject to damped oscillations, and control means for moving the movable device between its rest position and its operating position;

whereby, after striking the fixed contacts, the movable contact is subject to the combined effect of a static load and damped vibrations which cause a resilient deflection of the movable contact having a substantially constant static deflection component and a damped oscillating component, the damped oscillating component alternately parallel to and opposite the static load, the device being such that the static component of the deflection of the movable contact is greater than or at least equal to the maximum value assumed by the oscillation of the dynamic component opposite the static component, so as to maintain engagement of the movable contact with the two fixed contacts.

3. An electric switch according to claim 1 or claim 2, wherein the dimensions of the movable contact are such that its elastic constant is less than or at most equal to $wF/V_0$, wherein w is the angular frequency of the oscillation of said movable contact, F is the static force urging said movable contact against the fixed contacts, and $V_0$ is the speed of the movable contact when its resilient reaction force equals the static force F.

* * * * *